US007278513B2

(12) United States Patent
Brawley, Jr.

(10) Patent No.: US 7,278,513 B2
(45) Date of Patent: Oct. 9, 2007

(54) INTERNAL LENS SYSTEM FOR LOUDSPEAKER WAVEGUIDES

(75) Inventor: James S. Brawley, Jr., Clemson, SC (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 10/180,691

(22) Filed: Jun. 26, 2002

(65) Prior Publication Data

US 2003/0188920 A1 Oct. 9, 2003

Related U.S. Application Data

(60) Provisional application No. 60/370,273, filed on Apr. 5, 2002.

(51) Int. Cl.
*H04R 7/00* (2006.01)

(52) U.S. Cl. ..... 181/176; 181/187; 181/152; 181/199; 181/191

(58) Field of Classification Search ..... 181/176, 181/180–184, 156, 21, 177, 152, 210; 340/388.2; 116/137 R, 142 R; 381/157, 154, 159, 152, 381/153, 340, 338; 367/150, 140
See application file for complete search history.

(56) References Cited

U.S. PATENT DOCUMENTS 969,126 A * 8/1910 White ..... 181/181
1,067,905 A 7/1913 English
2,001,089 A 5/1935 Blattner
2,684,724 A * 7/1954 Kock ..... 181/176
2,819,771 A * 1/1958 Kock ..... 181/176
2,848,058 A 8/1958 Hartsfield
3,027,964 A 4/1962 Spragins, Jr. et al.
3,735,336 A * 5/1973 Long ..... 367/150
3,776,361 A * 12/1973 Rolle ..... 367/150
3,957,134 A * 5/1976 Daniel ..... 181/176
4,071,112 A 1/1978 Keele, Jr.
4,091,891 A * 5/1978 Hino et al. ..... 181/185
4,156,476 A * 5/1979 Matsumoto et al. ..... 181/210
4,164,631 A * 8/1979 Garner et al. ..... 381/340
4,344,504 A 8/1982 Howze
4,390,078 A 6/1983 Howze et al.
4,445,380 A 5/1984 Kaminski
4,470,308 A * 9/1984 Hayakawa et al. ..... 73/642
4,685,532 A * 8/1987 Gunness ..... 181/185
4,726,444 A * 2/1988 Iida et al. ..... 181/176

(Continued)

OTHER PUBLICATIONS

Kock, W. and Harvey, F.K., "Refracting Sound Waves," *The Journal of the Acoustical Society of America*, vol. 21, No. 5, Sep. 1949.

(Continued)

*Primary Examiner*—Lincoln Donovan
*Assistant Examiner*—Renata McCloud

(57) ABSTRACT

This invention provides a lens system for a loudspeaker. The loudspeaker may include a driver unit and a waveguide attached to the driver unit. The loudspeaker further may include a lens system. The lens system may include a plurality of plates. The plates may be positioned to divide an interior of the waveguide into a plurality of acoustic paths of substantially equal length. The acoustic paths may bend the propagation of one or more acoustic elements of a sound wave so that each acoustic element arrives at a plane substantially at the same time.

49 Claims, 5 Drawing Sheets

U.S. PATENT DOCUMENTS

| | | | | | |
|---|---|---|---|---|---|
| 4,753,318 | A | * | 6/1988 | Mizuno et al. | 181/204 |
| 4,764,905 | A | * | 8/1988 | Granz et al. | 367/140 |
| 4,776,428 | A | * | 10/1988 | Belisle | 181/185 |
| 4,836,328 | A | | 6/1989 | Ferralli | |
| 4,852,682 | A | * | 8/1989 | Benjamin | 181/121 |
| 4,945,334 | A | * | 7/1990 | Biersach | 340/388.2 |
| 5,163,167 | A | | 11/1992 | Heil | |
| 5,168,130 | A | * | 12/1992 | Shima et al. | 181/206 |
| 5,214,394 | A | | 5/1993 | Wong | |
| 5,524,062 | A | * | 6/1996 | Oh | 381/338 |
| 6,095,279 | A | * | 8/2000 | Adamson | 181/152 |
| 6,112,847 | A | * | 9/2000 | Lehman | 181/152 |
| 6,394,223 | B1 | * | 5/2002 | Lehman | 181/152 |
| 6,581,719 | B2 | * | 6/2003 | Adamson | 181/182 |
| 6,628,796 | B2 | * | 9/2003 | Adamson | 381/342 |
| 6,744,899 | B1 | * | 6/2004 | Grunberg | 381/343 |
| 2002/0114482 | A1 | * | 8/2002 | Adamson | 381/340 |
| 2003/0132056 | A1 | * | 7/2003 | Meyer et al. | 181/187 |

OTHER PUBLICATIONS

Frayne, J. and Loganthi, B., "Theater Loudspeaker System Incorporating an Acoustic-Lens Radiator," *Journal of the SMPTE*, vol. 63, Sep. 1954.

Augspurger, G., "The Acoustical Lens," *Electronics World*, Dec. 1962.

X-Line™ Speaker System User's Guide, Chapter 3: Linear Arrays 2001 Telex Communications, Inc. (Cover Sheet and pp. 9-15).

X-Line™ Speaker System User's Guide, Chapter 2: Linear Arrays 2001 Telex Communications, Inc. (Cover Sheet and pp. 5-8, Insert (1 page)).

JBL Professional Division, JBL Incorporated, 8500 Balboa Boulevard, P.O. Box 2200, Northridge, California 91329 (4 pages).

* cited by examiner

INTERNAL LENS SYSTEM FOR LOUDSPEAKER WAVEGUIDES

RELATED APPLICATION DATA

This patent claims the benefit of U.S. Provisional Application No. 60/370,273, filed Apr. 5, 2002, which application is incorporated by reference to the extent permitted by law.

BACKGROUND OF THE INVENTION

1. Technical Field

This invention relates to loudspeaker waveguides having internal plates that alter sound path lengths of acoustic elements.

2. Related Art

An individual loudspeaker typically has a driver unit connected to an outwardly expanding horn. In many loudspeakers, sound waves uniformly travel from the driver unit as a point source through the horn and outward in all directions. The resulting sound wave shape, usually known as spherical sound radiation, is similar to the ice-cream cone (hemisphere topped cone) shape of light traveling from a flashlight. However, a loudspeaker that directs sound waves uniformly in all directions generally is efficient only if listeners are located in each direction that the sound travels. Listeners in large-scale indoor and outdoor arenas typically are located only in a restricted listening area. For these arenas and in other applications, that portion of the acoustical power utilized to radiate sound waves upward above the loudspeaker largely is wasted.

In contrast to spherical sound radiation, cylindrical sound radiation essentially expands horizontally without expanding upward. The horizontal expansion of cylindrical sound radiation reaches out towards an audience while minimizing upward sound travel. Thus, cylindrical sound radiation is more efficient than spherical sound radiation in many loudspeaker applications.

One technique that created cylindrical sound radiation from loudspeakers involved vertically stacking a group of loudspeaker drivers so close together that the combined output took on a coherent wave front characteristic. This technique effectively converted the sound waves from each point source at the driver units to a plane source just outside of the end of the horns. However, the utilization of so many drivers to create cylindrical sound radiation often makes this a costly technique. Therefore, there is a need for a loudspeaker system that inexpensively produces cylindrical sound radiation.

SUMMARY

The invention provides a lens system for a loudspeaker that creates cylindrical sound radiation from spherical sound radiation. In this system, individual plates of the lens system are arranged in the path of acoustic sound waves that travel within a waveguide. This may bend the propagation of a sound wave to equalize the path length traveled by acoustic elements of the sound wave. By substantially equalizing the path length, the acoustic elements arrive substantially at the same time at an end of the waveguide to create cylindrical sound radiation. One result may be that a loudspeaker with the lens system is louder than a loudspeaker without the lens system when measured at the same remote distance.

This invention provides a lens system for a loudspeaker. The loudspeaker may include a driver unit and a waveguide attached to the driver unit. The loudspeaker further may include a lens system. The lens system may include a plurality of plates. The plates may divide an interior of the waveguide into a plurality of acoustic paths of substantially equal length. The acoustic paths may bend the propagation of one or more acoustic elements of a sound wave so that each acoustic element arrives at a plane substantially at the same time.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis being placed instead upon illustrating the principles of the invention. In the figures, like reference numerals designate corresponding parts throughout the different views.

DETAILED DESCRIPTION

Figure 1:
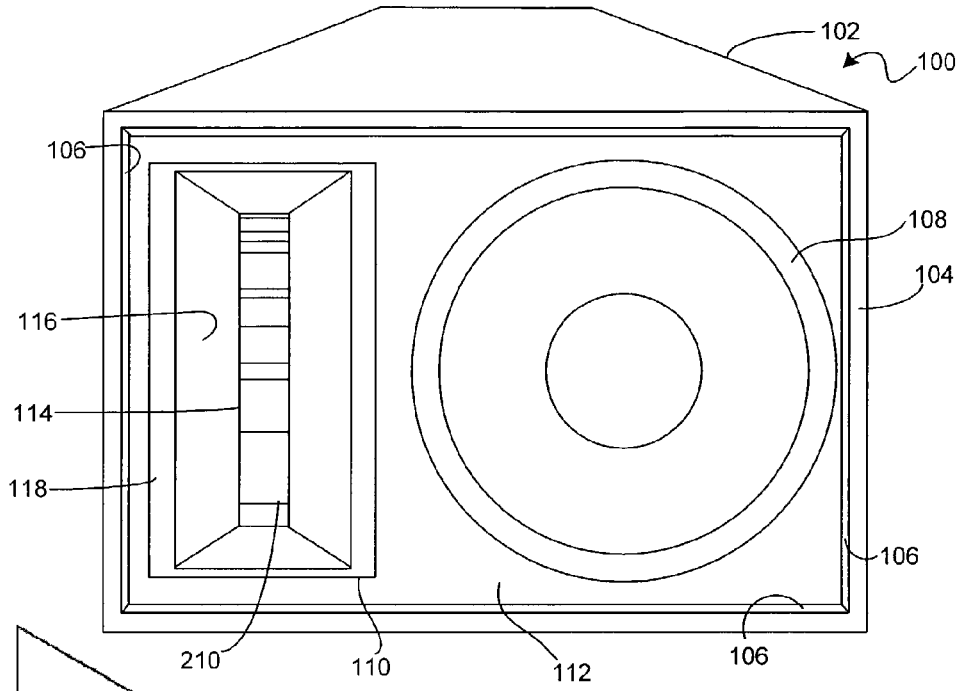
FIG. 1 is a perspective view illustrating a loudspeaker system.

FIG. 1 is a perspective view illustrating a loudspeaker system 100. The loudspeaker system 100 may be any device that converts signals into sounds. The loudspeaker system 100 may be able to reproduce a wide range of audio frequencies (i.e., 20 hertz (Hz) to 20 kilohertz (kHz)) as sounds loud enough for listeners to hear over a distance.

The loudspeaker system 100 may include a shell or housing 102 having a frame 104. The frame 104 may include a recess 106 into which a grill may fit. The grill may include a tight mesh that both permits audible sound to pass through and prevents dust and other objects from passing into the housing 102.

In many instances, it may be difficult for a single loudspeaker to reproduce a wide range of audio frequencies adequately. To provide a wider frequency reproduction range, the loudspeaker system 100 may include loudspeakers such as selected from loudspeakers of three different sizes. The largest loudspeakers, or woofers, may reproduce low frequencies (about 200 Hz or less). The medium-sized loudspeakers, or midrange loudspeakers, may reproduce middle frequencies (about 1.5 kHz to 20.0 kHz). The smallest loudspeakers, or tweeters, may reproduce high frequencies (about 6.0 kHz or more). The loudspeaker system 100 may include a crossover device to ensure that each loudspeaker receives signals only in the frequency range it is designed to reproduce.

FIG. 1 shows the loudspeaker system 100 as having a woofer 108 and a loudspeaker 110. The loudspeaker 110 of FIG. 1 is shown as a midrange loudspeaker, but may be any frequency size of loudspeaker. A baffle board 112 may secure the woofer 108 and the loudspeaker 110 to the housing 102.

The loudspeaker 110 may include a slot 114 and a mouth 116. The slot 114 may include an elongated opening in the vertical direction as compared to its extension in the horizontal direction. The vertical elongation of the slot 114 may function to control vertical expansion of sound waves, such as through diffraction. The short, horizontal span of the slot 114 may provide minimal to no control over horizontal expansion of sound waves. When having this rectangular shape, the slot 114 may be referred to as a diffraction slot. The ratio of the vertical to horizontal dimensions of the slot 114 may be any ratio, such as two to one, seven to one, or thirty-one to one, for example.

The mouth 116 may expand outward from the slot 114 to a flange 118. The outward expansion of the mouth 116 may provide control over the horizontal expansion of sound waves. The outward expansion also may contribute to the control over the vertical expansion of sound waves. The flange 118 may secure the mouth 116 and the baffle board 112 to one another.

Figure 2:
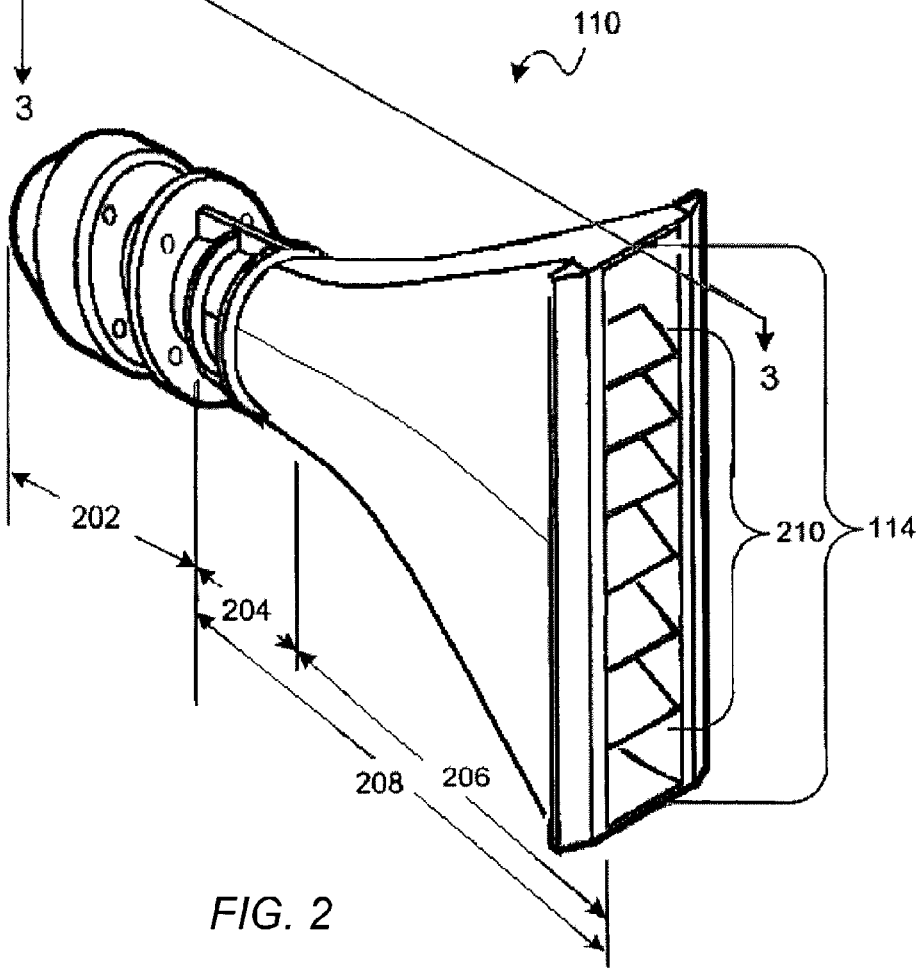
FIG. 2 is a perspective view illustrating a loudspeaker without a mouth.

FIG. 2 is a perspective view illustrating the loudspeaker 110 without the mouth 116. The loudspeaker 110 may include a driver unit 202, a throat 204, and a flare 206. The driver unit 202 may act as a sound source. The throat 204 may be a vent that restricts the movement of air mass within the throat 204. The flare 206 may include a changing internal cross-sectional area. Typically, the internal cross-sectional area may be an expanding area moving away from the driver unit 202.

The driver unit 202, the throat 204, and the flare 206 may be acoustically coupled to one another. The throat 204 and the flare 206 may form a horn 208. One or both of the flare 206 and the mouth 116 (FIG. 1) may identify a waveguide. The waveguide may act to direct the sound waves outward along a vertical axis and, in some instances, a horizontal axis of the horn 208.

In operation, the driver unit 202 may create sound waves from electrical signals as follows. The driver unit 202 may convert received electrical signals into acoustic energy through a sound-producing element, such as a fast-moving diaphragm. The acoustic energy may force the air mass within the throat 204 towards the flare 206. Pressure variation within the throat 204 may function to force the air mass to speed up and gain kinetic energy as the air mass passes through restrictions of the throat 204. As the air mass moves into and through the flare 206, the air mass may progressively expand as sound waves. Eventually, these sound waves may reach listeners within an audience listening area.

The sound waves within the flare 206 may initially expand as a growing spherical wave having an apex leading the remaining parts of the sound wave. With no other interference, the apex may reach a plane of the slot 114 first followed by the remaining parts of the sound wave. However, causing the apex and the remaining parts of the sound wave to reach a plane of the slot 114 at approximately the same time may create cylindrical sound radiation.

The loudspeaker system 100 further may include a lens system 210 placed within the path of the sound waves. The lens system 210 may divide the sound wave into acoustic elements and subsequently bend some of the sound wave propagation. The lens system 210 also may increase the path length of some of the acoustic elements so that each acoustic element in the sound wave passes through a plane at approximately the same time. In effect, the lens system 210 may flatten the spherical wave to vertically diverging spherical sound radiation originating from a single driver unit 202 to cylindrical sound radiation.

Figure 3:
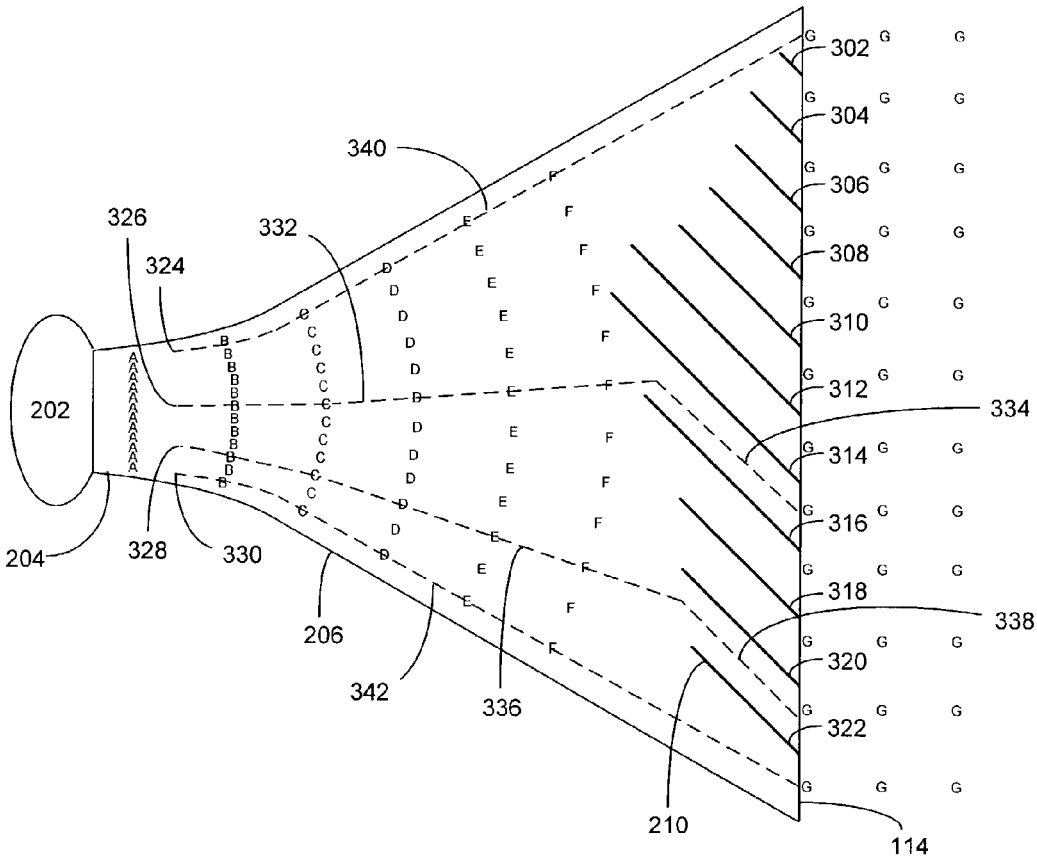
FIG. 3 is a schematic section view of a loudspeaker taken off line 3-3 of FIG. 2 and showing a lens system.

FIG. 3 is a schematic section view of the loudspeaker 110 taken off line 3-3 of FIG. 2 and showing the lens system 210. In FIG. 3, the lens system 210 may include a plurality of plates, such as a plate 302, a plate 304, and a plate 306. The lens system 210 additionally may include a plate 308, a plate 310, a plate 312, a plate 314, a plate 316, a plate 318, a plate 320, and a plate 322. The acoustic elements may travel in a spherical radiation pattern from the driver unit 202 as indicated by the letters A, B, C, D, E, and F of FIG. 3. On reaching the lens system 210, the plates 302-322 may divide sound waves into a number of acoustic elements, such as acoustic elements 324, 326, 328, and 330. The plates 302-322 may increase the distance traveled by an acoustic element from the driver unit 202 to a far end of the lens system 210. For example, the acoustic element 326 first may travel along a path 332. On reaching a region between the plate 314 and the plate 316, the acoustic element 326 may then travel along a path 334 until the acoustic element 326 reaches the slot 114. Similarly, the acoustic element 328 may travel along a path 336 and then along a path 338.

The characteristics of the lens system 210 may substantially function to bend the sound wave propagation of some of the acoustic elements. This may substantially equalize the path length traveled by each acoustic element. For example, a path 340 traveled by acoustic element 324 may be substantially equal to the path 332 plus the path 334 and substantially equal to the path 336 plus the path 338. A path length 342 traveled by acoustic element 330 substantially may equal the path 340, the path 332 plus the path 334, or the path 336 plus the path 338. In this way, the lens system 210 may change the spherical patterns A, B, C, D, E, and F into cylindrical sound radiation patterns as indicated by the letters G.

The lens system 210 may be implemented in a variety of ways. For example, in FIG. 3, each plate 302-322 may be positioned parallel to one another and at an angle to a path of an associated acoustic element. The angle may be in a range of approximately 30.0 degrees to approximately 70.0 degrees. The angle may be approximately 45.0 degrees.

Some of the plates 302-322 may extend from the slot 114 at different lengths. One end of each plate 302-322 may attach to the slot 114. A free end of each plate may extend to block sound radiation from traveling in a direct path from the throat 204 to the slot 114. The length of the longest plate 302-322 may be less than a length of the flare 206 (FIG. 2). For example, the longest plate may have a length that may be approximately 0.1 to approximately 0.5 of the length of the flare 206. The longest plate may have a length that may be not more than 0.5 of the length of the flare 206.

Figure 4:
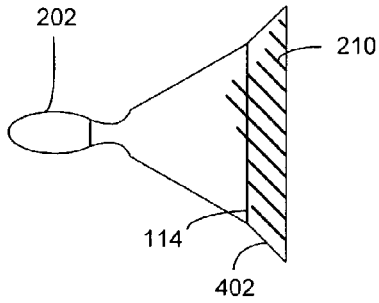
FIG. 4 is a side section view illustrating the utilization of a frame.

FIG. 4 is a side section view illustrating the utilization of a frame 402. The plates 302-322 may attach to the frame 402. The frame 402 may then attach to the slot 114. The frame 402 also may function as the mouth 116 of FIG. 1. When functioning as the mouth 116, the frame 402 effectively may increase the height of the slot 114. The slot 114 may have an effective height that may be approximately 5.0 to approximately 10.0 times the height of a sound-producing element within the driver unit 202. By increasing the effective height of the slot 114, the loudspeaker 110 may process lower frequency sound waves without the need to utilize additional driver units 202.

Figure 5:
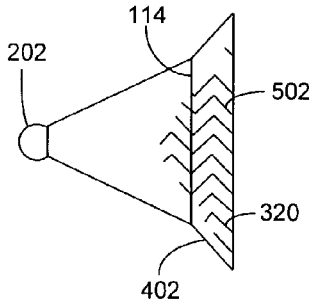
FIG. 5 is a side section view illustrating folded or saw-toothed plates in the lens system.

FIG. 5 is a side section view illustrating folded or saw-toothed plates 502 in the lens system 210. The plate 320, for example, initially may extend in a first direction and then in a second direction to form the folded plates 502. The other plates may extend in multiple directions as well. The folded plates 502 may force the acoustic elements to traverse longer paths.

Figure 6:
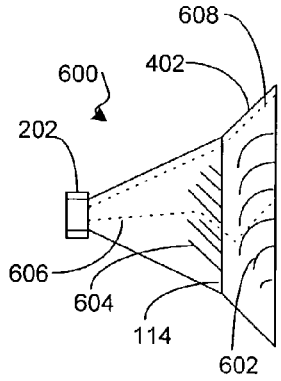
FIG. 6 is a side section view illustrating a variation on the number of lens systems employed in a loudspeaker.

FIG. 6 is a side section view illustrating a variation on the number of lens systems employed in a loudspeaker 600. The loudspeaker 600 may include a first lens. system 602 positioned within the frame 402 and a second lens system 604 positioned at the slot 114. The first lens system 602, shown as curved plates, may be disconnected from the second lens system 604. Here, an acoustic element path 606 may substantially equal an acoustic element path 608.

Under some circumstances, the frequency wavelength of the sound from the driver unit 202 may be longer than a height of the slot 114. For example, at a frequency of 10,000 Hz, the wavelength may be about 1.2 inches. At a frequency of 1,000 Hz, the wavelength may be about 13.0 inches. At a very low base frequency of 100 hz, the wavelength may be about 11.0 feet. Under most circumstances, it may be commercially impracticable to manufacture a slot length of 11.0 feet.

Figure 7:
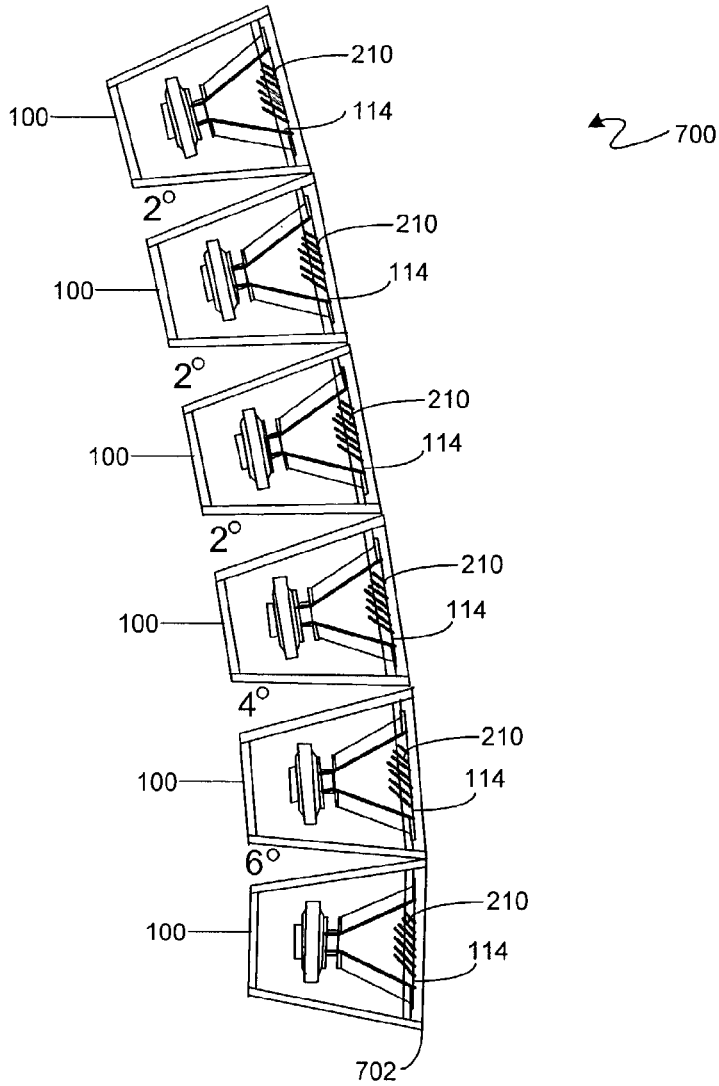
FIG. 7 is an elevated isometric view of multiple loudspeaker systems stacked on top of one another in a line-source loudspeaker array.
Figure 8:
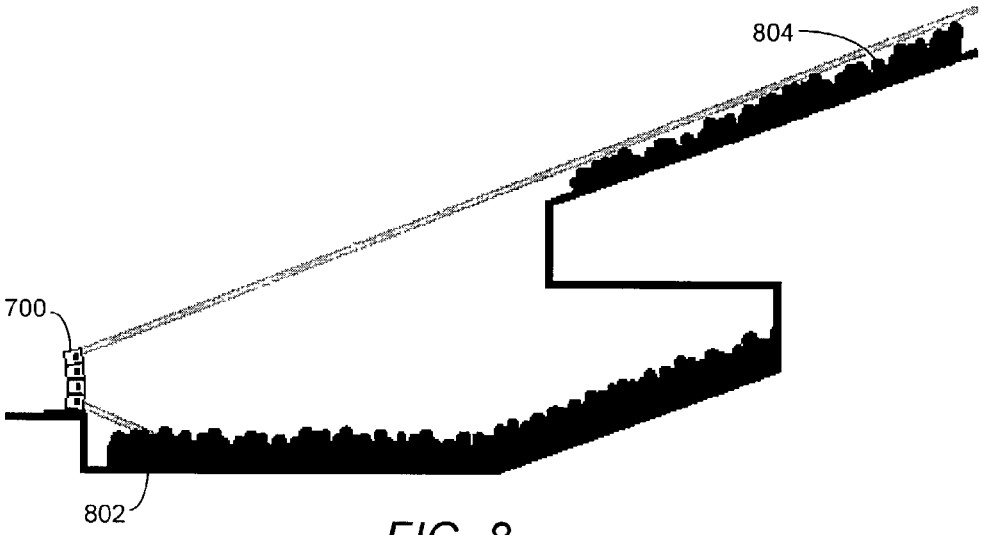
FIG. 8 is a side view of the line-source loudspeaker array positioned to cover an audience listening area.

To create cylindrical sound radiation for frequencies lower than 1,000 Hz, multiple loudspeakers 110 may be stacked on top of one another. FIG. 7 is an elevated isometric view of multiple loudspeaker systems 100 stacked on top of one another in a line-source loudspeaker array 700. In this arrangement, the interaction of the sound waves from each lens system 210 may function to permit each slot 114 to act as a true line-array element. Moreover, by angling the individual loudspeaker systems 100 with respect to one another along a curve 702 in the vertical plane, the line-source loudspeaker array 700 provides vertical coverage for local listeners 802 and remote listeners 804 as in FIG. 8.

Figure 9:
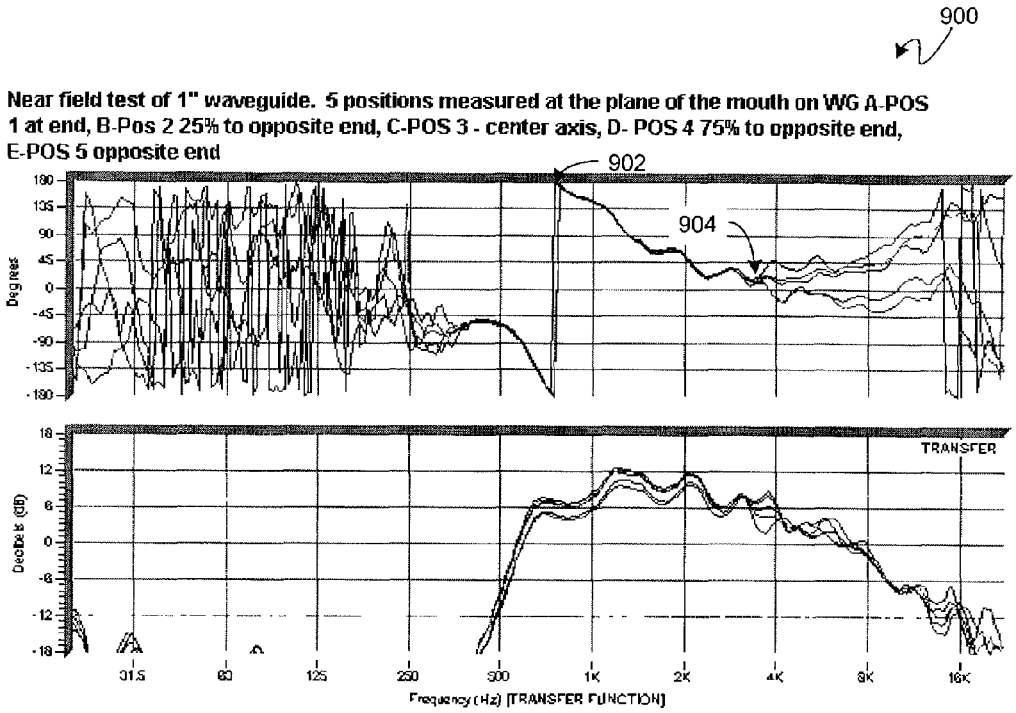
FIG. 9 is a graph illustrating the results of a near field test on a loudspeaker without a lens system installed.
Figure 10:
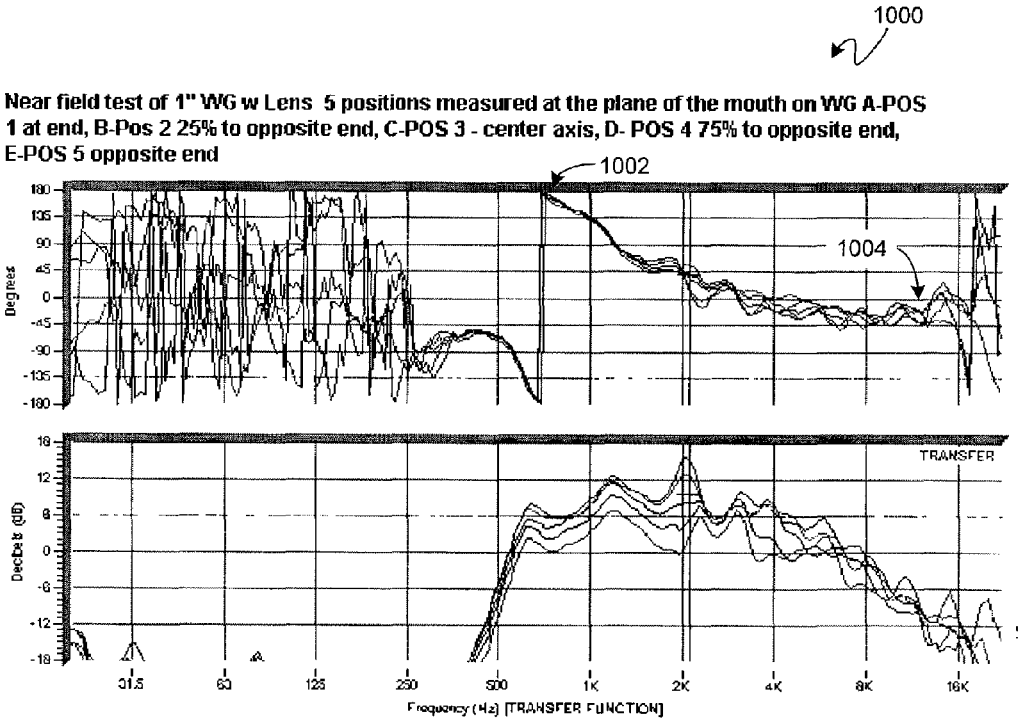
FIG. 10 is a graph illustrating the results of a near field test on a loudspeaker with a lens system installed.

FIG. 9 is a graph 900 illustrating the results of a near field test on a loudspeaker without a lens system installed. FIG. 10 is a graph 1000 illustrating the results of a near field test on a loudspeaker with a lens system 210 installed. Each test utilized a slot 114 measuring about four inches in vertical length by one inch in horizontal length. Seven plates where spaced about one-half of an inch apart within the slot 114. A mouth was not attached to the slot 114. Five microphones were positioned along the length of the slot 114: two near the vertical ends of the slot 114, one near the center of the slot 114, and the remaining two evenly distributed along the slot 114.

During the tests, a pink noise signal energized the lens system 210 as input. The pink noise approximately included equal energy at each octave band. The input is plotted in FIG. 9 as decibels vs. frequency. For the output, each microphone recorded the arrival of an acoustic element of a sound wave at the slot 114 over various frequencies. The results were measured by a real-time, sound-system measurement application. The measurement application converted the arrival of an acoustic element of a sound wave at the slot 114 into a phase as measured in degrees and plotted the results in degrees as a function of frequency.

Directivity generally is known as a property of a loudspeaker to direct acoustic sound in one direction over other directions. Directing more loudspeaker energy along a primary radiation axis as compared to off primary axis directions may increase directivity. A small to zero degree phase shift between the acoustic elements of a sound wave may imply a good directivity. As the phase shift between the acoustic elements increases, the directivity capability of a loudspeaker may decrease.

By way of example, the line-source loudspeaker array 700 of FIG. 7 may exhibit high directivity where the phase shift between each acoustic element over their collective surface of radiation substantially is zero degrees. Each individual loudspeaker system 100 may contribute to this high directivity where the loudspeaker system 100 exhibits low phase shift across the sound wave leading surface over the frequency bandwidth. For a loudspeaker system to be suitable for use at high frequencies, the phase shift across the sound wave leading surface should be small.

The phase of each acoustic element with respect to the remaining acoustic elements may be observed in FIG. 9 and FIG. 10. Without the lens system 210 installed, the phase of each acoustic element remained aligned from about 750 Hz (FIG. 9, arrow 902) to about 3,500 Hz (arrow 904). The phase of each acoustic element began to spread from one another above 3,500 Hz. In this test, the desired cylindrical sound radiation occurred only at low frequencies such that the output of the tested loudspeaker 110 fell apart at higher frequencies. Thus, the tested device would not beneficially contribute to the directivity of a line-source loudspeaker array above 3,500 Hz.

With the lens system 210 installed, the phase of each acoustic element remained aligned from about 750 Hz (FIG. 10, arrow 1002) to about 14,000 Hz (arrow 1004). Only after about 14,000 Hz did the acoustic sound begin to diverge spherically from the slot 114. By extending the directivity frequency bandwidth, the lens system 210 significantly improves a loudspeaker's ability to direct acoustic sound in one direction over other directions.

Figure 11:
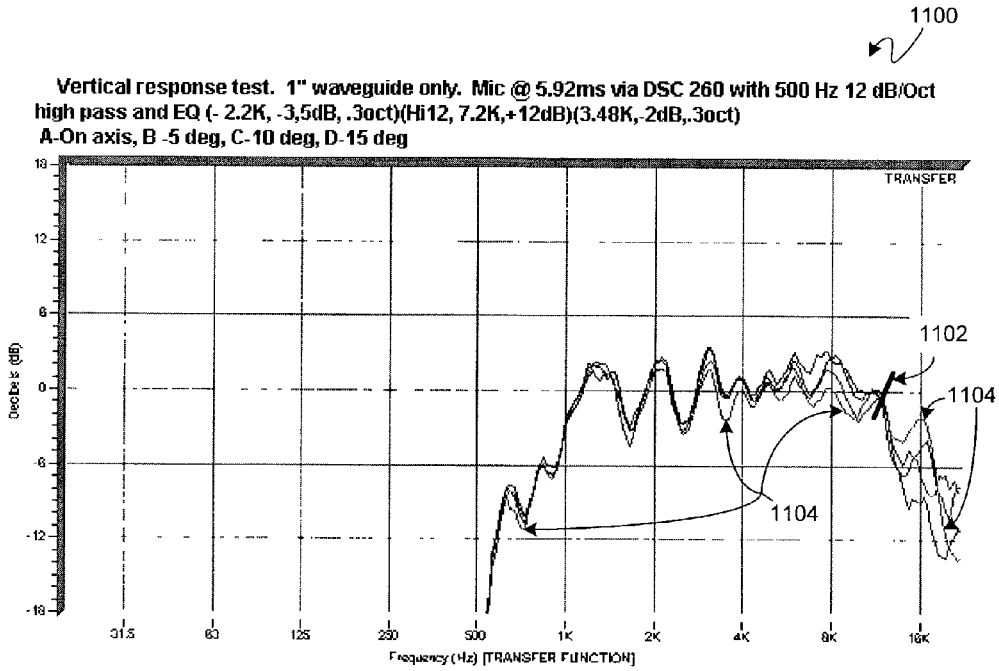
FIG. 11 is a graph illustrating the results of a vertical response test on a loudspeaker without a lens system installed.
Figure 12:
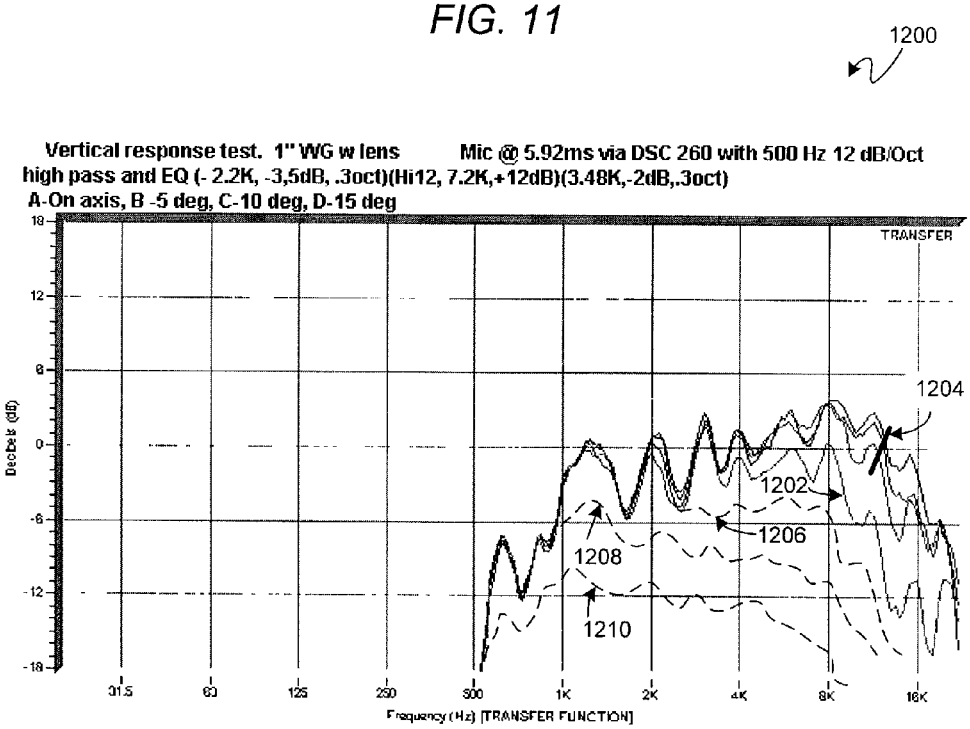
FIG. 12 is a graph illustrating the results of a vertical response test on a loudspeaker with a lens system installed.

FIG. 11 is a graph 1100 illustrating the results of a vertical response test on a loudspeaker without a lens system installed. FIG. 12 is a graph 1200 illustrating the results of a vertical response test on a loudspeaker with a lens system 210 installed. In these tests, the microphones were positioned about 5.5 feet away from the slot 114. A first microphone was aligned with the horizontal axis of the slot 114 and the remaining three microphones vertically offset from the first microphone approximately in five-degree increments. The results were recorded in acoustic sound level (decibels) vs. frequency.

The plots crossing a line 1102 in FIG. 11 (lens system 210 not installed) show that the acoustic sound level substantially remained the same. In particular, the acoustic sound level for the fifteen-degree measurement (line 1104) remained with the other measured acoustic sound levels. After installing the lens system 210, the acoustic sound level measured fifteen degrees away from the horizontal axis (line 1202 in FIG. 12) dropped below the remaining acoustic sound levels (line 1204) at approximately 4,000 Hz. In other words, the tested loudspeaker system 100 desirably was louder along the horizontal axis than along positions fifteen or greater degrees off the horizontal axis. Thus, the lens system 210 improved the directivity of the tested loudspeaker system.

One technique to improve the test results in FIG. 12 may include stacking two or more loudspeaker systems such as in the line-source loudspeaker array 700 of FIG. 7. For example, if two loudspeaker systems 100 were vertically stacked on one another as an array, the fifteen-degree measurement may drop off at around 2,000 Hz (line 1206). If four loudspeaker systems 100 were vertically stacked on one another as an array, the fifteen-degree measurement may drop off at around 1,000 Hz (line 1208). Moreover, if eight loudspeaker systems 100 were vertically stacked on one another as an array, the fifteen-degree measurement may drop off at around 500 Hz (line 1210).

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A loudspeaker, comprising:

a driver unit capable of producing sound waves;

a waveguide for receiving sound waves produced by the driver unit, the waveguide having:

a throat coupled to the driver unit, and a flare extending from the throat and having a changing internal cross-sectional area; and a waveguide front defining an exit plane; and a lens system having a plurality of plates, where the plurality of plates are positioned substantially at an end opposite the throat such that a portion of the flare provides a space for spherical sound radiation to divide an interior of the waveguide into a plurality of acoustic paths each path defined by a first path within the space for spherical sound radiation and a second path between plates, the plurality of acoustic paths allowing the sound waves produced by the driver to reach the exit plane and where at least two of the plurality of plates are of different length so that the plurality of acoustic paths are substantially the same length where the lens system flattens the spherical sound radiation originating from the throat to cylindrical sound radiation at the exit plane.

2. The loudspeaker of claim 1, where the plurality of plates are parallel to each other.

3. The loudspeaker of claim 2, where the plurality of plates extend from a slot at different lengths.

4. The loudspeaker of claim 3, where a length of the longest plate is less than a length of a flare of the waveguide.

5. The loudspeaker of claim 4, where the length of the longest plate is approximately 0.1 to 0.5 of the length of the flare.

6. The loudspeaker of claim 4, where the length of the longest plate is not more than 0.5 of the length of the flare.

7. The loudspeaker of claim 1, where the waveguide is configured to propagate a sound wave in a propagation direction and where the plurality of plates are positioned at a first angle to the propagation direction.

8. The loudspeaker of claim 7, where the first angle is in a range of approximately 30.0 degrees to approximately 70.0 degrees.

9. The loudspeaker of claim 7, where the first angle is approximately 45.0 degrees.

10. The loudspeaker of claim 7, where at least one plate is positioned at a first angle to the propagation direction and at a second angle to the propagation direction.

11. The loudspeaker of claim 1, where the waveguide includes a horn, the loudspeaker further comprising a frame attached to the horn, where the plurality of plates are attached to the frame.

12. The loudspeaker of claim 11, where the frame is a mouth.

13. The loudspeaker of claim 12, where a height of the mouth is approximately 5.0 to approximately 10.0 times a height of a sound-producing element within the driver unit.

14. The loudspeaker of claim 13, where the plurality of plates extend from a slot at different lengths and where a length of the longest plate is approximately 0.1 to 0.5 of a length of a flare of the waveguide.

15. The loudspeaker of claim 1, where the lens system includes a first lens system and a second lens system positioned remote from the first lens system.

16. A loudspeaker comprising:

means for producing a sound wave;

means for guiding the sound wave, where the means for guiding the sound wave includes an interior extending from the means for producing a sound wave at a changing cross-sectional area and a waveguide front defining an exit plane; and means for dividing the interior into a first space for spherical sound radiation and a second space having a plurality of plates defining a plurality of acoustic paths each path defined by a first path within the space for spherical sound radiation and a second path between plates, the plurality of acoustic paths allowing the sound waves produced by the driver to reach the exit plane and where at least two of the plurality of plates are of different length so that the plurality of acoustic paths are substantially the same length whereby the plurality of plates flatten the spherical sound radiation to cylindrical sound radiation at the exit plane.

17. The loudspeaker of claim 16, where means for dividing the interior includes a plurality of plates.

18. The loudspeaker of claim 17, where the plurality of plates are parallel to each other.

19. The loudspeaker of claim 18, where the plurality of plates extend from a slot at different lengths.

20. The loudspeaker of claim 19, where a length of the longest plate is less than a length of a flare of the waveguide.

21. The loudspeaker of claim 20, where the length of the longest plate is approximately 0.1 to 0.5 of the length of the flare.

22. The loudspeaker of claim 20, where the length of the longest plate is not more than 0.5 of the length of the flare.

23. The loudspeaker of claim 16, where the means for guiding the sound wave is a waveguide, where the waveguide is configured to propagate a sound wave in a propagation direction, and where the plurality of plates are positioned at a first angle to the propagation direction.

24. The loudspeaker of claim 23, where the first angle is in a range of approximately 30.0 degrees to approximately 70.0 degrees.

25. The loudspeaker of claim 23, where the first angle is approximately 45.0 degrees.

26. The loudspeaker of claim 23, where at least one plate is positioned at a first angle to the propagation direction and at a second angle to the propagation direction.

27. The loudspeaker of claim 16, where the waveguide includes a horn, the loudspeaker further comprising a frame attached to the horn, where the plurality of plates are attached to the frame.

28. The loudspeaker of claim 27, where the frame is a mouth and where the means for producing the sound wave is a driver unit.

29. The loudspeaker of claim 28, where a height of the mouth is approximately 5.0 to approximately 10.0 times a height of a sound-producing element within the driver unit.

30. The loudspeaker of claim 29, where the plurality of plates extend from a slot at different lengths and where a length of the longest plate is approximately 0.1 to 0.5 of a length of a flare of the waveguide.

31. The loudspeaker of claim 16, where the means for dividing the interior includes a first lens system and a second lens system positioned remote from the first lens system.

32. A line-source loudspeaker array, comprising:

a plurality of loudspeaker systems connected to each other where at least two loudspeaker systems each have a sound driver, a slot, a waveguide and a lens system, where each lens system includes a plurality of plates that are positioned substantially at an end opposite the sound driver such that a portion of the waveguide provides a space for spherical sound radiation, the plurality of plates dividing an interior of the waveguide into a plurality of acoustic paths each path defined by a first path within the space for spherical sound radiation and a second path between plates the plurality of acoustic paths allowing the sound waves produced by the driver to reach an exit plane defined by the front of the waveguide and where at least two of the plurality of plates are of different length so that the plurality of acoustic paths are substantially the same length where the lens system flattens the spherical sound radiation originating from the throat to cylindrical sound radiation at the exit plane.

33. The line-source loudspeaker array of claim 32, where the plurality of plates are parallel to each other.

34. The line-source loudspeaker array of claim 33, where a length of the longest plate is less than a length of a flare of the waveguide.

35. The line-source loudspeaker array of claim 34, where the length of the longest plate is approximately 0.1 to 0.5 of the length of the flare.

36. The line-source loudspeaker array of claim 34, where the length of the longest plate is not more than 0.5 of the length of the flare.

37. The line-source loudspeaker array of claim 32, where at least one waveguide is configured to propagate a sound wave in a propagation direction and where the plurality of plates positioned with respect to the at least one waveguide are positioned at a first angle to the propagation direction.

38. The line-source loudspeaker array of claim 37, where the first angle is in a range of approximately 30.0 degrees to approximately 70.0 degrees.

39. The line-source loudspeaker array of claim 34, where the first angle is approximately 45.0 degrees.

40. The line-source loudspeaker array of claim 37, where at least one plate is positioned at a first angle to the propagation direction and at a second angle to the propagation direction.

41. The line-source loudspeaker array of claim 37, further comprising a frame attached to the at least one waveguide, where the plurality of plates are attached to the frame.

42. The line-source loudspeaker array of claim 41, where the frame is a mouth.

43. The line-source loudspeaker array of claim 42, where a height of the mouth is approximately 5.0 to approximately 10.0 times a height of a sound-producing element within the driver unit.

44. The line-source loudspeaker array of claim 43, where the plurality of plates extend from the slot at different lengths and where a length of the longest plate is approximately 0.1 to 0.5 of a length of a flare of the waveguide.

45. The line-source loudspeaker array of claim 32, where at least one lens system comprises a first lens system and a second lens system positioned remote from the first lens system.

46. The line-source loudspeaker array of claim 32, where a first loudspeaker is positioned at an angle to a second loudspeaker.

47. A loudspeaker comprising:

a driver unit for producing sound waves;

a waveguide for receiving sound waves produced by the driver unit, the waveguide including a space extending from the driver unit for spherical sound radiation and a slot lying along an exit plane from which sound waves exit the waveguide; and a plurality of plates extending from the exit plane into an interior of the waveguide to receive the spherical sound radiation from the space extending from the driver unit, the plurality of plates spaced apart from each other along the direction of the exit plane, at least two of the plates having different lengths, the plurality of plates dividing the interior into a plurality of acoustic paths running from the driver unit to the exit plane, at least two of the acoustic paths including respective acoustic path portions running between corresponding pairs of adjacent plates, and at least two of the acoustic path portions having different lengths, where the plurality of plates are positioned and sized such that the respective lengths of the acoustic paths from the driver unit to the exit plane are substantially equal to each other, and flattens the spherical sound radiation originating from the driver unit to cylindrical sound radiation at the exit plane.

48. The loudspeaker of claim 47, where the plurality of plates are oriented at a non-orthogonal angle relative to the exit plane.

49. The loudspeaker of claim 47, where the plurality of plates are arranged in parallel with each other.

* * * * *